United States Patent [19]

Trevathan et al.

[11] Patent Number: 4,601,427

[45] Date of Patent: Jul. 22, 1986

[54] ADHESIVE DISPENSING NOZZLE

[75] Inventors: Larry C. Trevathan, Westlake, Ohio; Jerry R. Farmer, Suwanee, Ga.

[73] Assignee: Nordson Corporation, Amherst, Ohio

[21] Appl. No.: 643,842

[22] Filed: Aug. 23, 1984

[51] Int. Cl.[4] ..... B05B 1/34

[52] U.S. Cl. ..... 239/11; 239/432; 239/590.5

[58] Field of Search ..... 239/589–590.5, 239/565, 450, 432, 1, 11

[56] References Cited

U.S. PATENT DOCUMENTS

| | | | |
|---|---|---|---|
| 1,412,767 | 4/1922 | Barber | 239/590 X |
| 2,606,071 | 8/1952 | Vensel | 239/590.3 |
| 3,941,314 | 3/1976 | Moss et al. | 239/590.3 X |
| 4,059,466 | 11/1977 | Scholl et al. . | |
| 4,059,714 | 11/1977 | Scholl et al. . | |
| 4,200,207 | 4/1980 | Akers et al. . | |
| 4,264,214 | 4/1981 | Scholl et al. . | |
| 4,295,573 | 10/1981 | Terry et al. . | |
| 4,405,063 | 9/1983 | Wydro et al. . | |

*Primary Examiner*—Andres Kashnikow

*Attorney, Agent, or Firm*—Wood, Herron & Evans

[57] ABSTRACT

A nozzle for dispensing a solution of molten hot melt and gas. Upon emerging from the nozzle, gas is released from the solution to form a foamed hot melt. The nozzle comprises a body having a liquid flow passage therein, which flow passage contains a restrictor at the upstream end and a diverter flow path at the downstream end.

6 Claims, 5 Drawing Figures

ADHESIVE DISPENSING NOZZLE

This invention relates to a nozzle for dispensing molten thermoplastic materials or so-called "hot melt" materials and more particularly to a nozzle for dispensing foamed hot melt materials. As used in this application, the term hot melt material or molten thermoplastic material is intended to be inclusive of such materials used as adhesives, caulks and sealants.

In U.S. Pat. Nos. 4,059,466, 4,059,714, 4,200,207, 4,264,214, 4,295,573 and 4,405,063, there are disclosed several different systems for dispensing foamed hot melt materials. The systems disclosed in all of these patents are operable to create a mixture of gas and molten hot melt and to force that gas into solution with the hot melt. That molten hot melt/gas solution is subsequently dispensed from a valved automatic or manual gun. Upon emerging from the gun, the gas evolves from the solution to create a foam, which foam is then usually compressed between two substrates so as to adhere those substrates.

All foamed hot melt dispensing systems are characterized by a valved dispenser or gun wherein there is a relatively high back pressure maintained on the hot melt/gas solution so as to maintain the gas in solution in the liquid hot melt. That back pressure is generally on the order of 500 to 1200 p.s.i. When the valve of the dispenser is opened, high pressure hot melt/gas solution is dispensed from a relatively small orifice of the gun at a high velocity. If the orifice is enlarged so as to reduce that hot melt/gas solution velocity, then the gas comes out of solution within the gun. It is therefore often difficult to control the deposition location of the material dispensed from the nozzle of the gun because of the tendency of the high velocity hot melt to bounce off of the target substrate. Additionally, the velocity is often so great that the gun becomes dangerous to use because of the possibility of the operator being accidentally injected with a stream of high velocity molten hot melt material.

It has therefore been an objective of this invention to provide an improved nozzle for a foamed hot melt dispenser which not only facilitates improved control of the hot melt/gas solution dispensed from the dispenser, but which also reduces the velocity of hot melt dispensed from the dispenser so as to render the gun less subject to operator injury.

These objectives are achieved and this invention is in part predicated upon the concept of dispensing foamed hot melt from a nozzle wherein the hot melt passes through a restrictor and out of the nozzle via a circuitous or diverter flow path located downstream from the restrictor.

The nozzle which utilizes this concept to improve the control of hot melt deposition as well as to reduce the exit velocity of the hot melt comprises a nozzle body having an axial bore extending from the inlet end thereof toward the outlet end of the nozzle, which inlet bore though terminates short of the outlet. This inlet bore is intersected by a second outlet bore which is laterally offset from the first inlet bore. There is an insert located within the inlet bore, which insert serves as a restrictor to the passage of foamed hot melt through the nozzle.

The advantage of this nozzle is that it not only improves control of deposition of the foamed hot melt dispensed from the gun, but it also reduces the exit velocity of hot melt material passing through the gun. Additionally, it has been found that this nozzle improves the quality of foamed hot melt dispensed from the nozzle, i.e. it assists in maintaining a more uniform foam dispensed from the gun than has heretofore been possible without the use of this nozzle.

These and other objects and advantages of this invention will be more readily apparent from the following description of the drawings in which.

Figure 1:
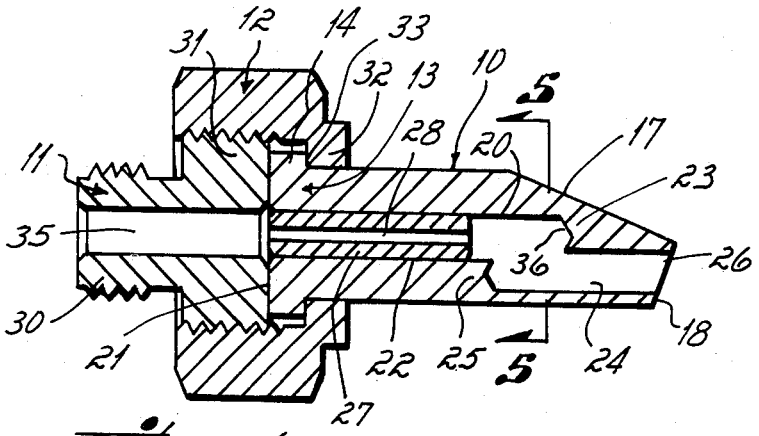
FIG. 1 is a cross sectional view through a nozzle, an adapter, and a nut incorporating the invention of this application.
Figure 2:
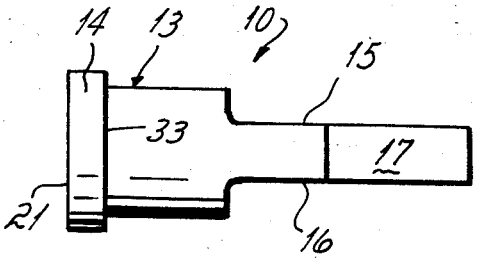
FIG. 2 is a top plan view of the nozzle of FIG. 1.
Figure 3:
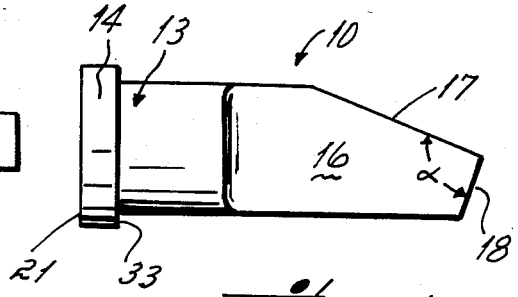
FIG. 3 is a side elevational view of the nozzle of FIG. 1.
Figure 4:
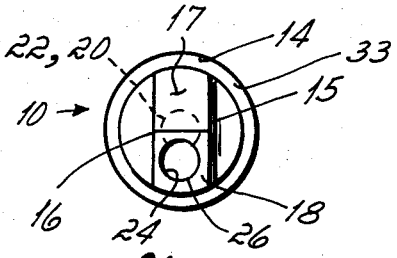
FIG. 4 is a front elevational view of the nozzle of FIG. 1.

Referring to the drawings, it will be seen that the nozzle of this invention comprises a nozzle body 10, an adapter 11, and a retaining nut 12. The adapter 11 and nut 12 are utilized to secure the nozzle body 10 to the end of a conventional foamed hot melt dispenser, such as a dispenser of the type described in U.S. Pat. No. 4,059,466.

The rear end 13 of the nozzle body is generally cylindrical in configuration and has an annular flange 14 extending outwardly therefrom. The front end of the nozzle body has flats 15 and 16 on the opposite sides thereof. The top surface 17 at the front end of the nozzle is flat and angled downwardly and forwardly. The front face 18 of the nozzle is flat and angled upwardly and forwardly so as to define an angle $\alpha$ of approximately 90° between the top surface 17 and the front surface 18.

Figure 5:
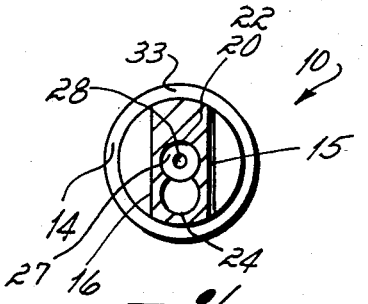
FIG. 5 is a cross sectional view taken on line 5—5 of FIG. 1.

There is a flow passage 20 which extends from the rear face 21 of the nozzle body 10 to the front face 18. This passage is defined by an axial bore 22 which extends from the rear face 21 of the body to a blind end 23. This axial passage is intersected by a parallel but laterally offset passage 24 which extends from the front face 18 to a blind end 25. As may be seen most clearly in FIGS. 1 and 5, the two blind passages or bores 22, 24 intersect near the end of both passages or bores 22, 24. Thereby, a through flow passage is defined by the two bores from the rear surface 21 of the nozzle body 10 to the discharge orifice 26 in the front face 18 of the nozzle body.

Contained internally of the axial bore 22, there is an insert 27. This insert is sealingly secured within the axial passage 22 by being brazed or welded therein. This insert has a small axial bore 28 extending therethrough, which bore serves as a restricted flow passage for hot melt material flowing from the rear inlet end of the flow passage 20 to the discharge orifice 26 in the front surface 18 of the nozzle body 10.

The nozzle body 10 is secured onto the discharge end of a conventional manual or automatic dispenser gun by the nut 12. This nut may be threaded directly onto the end of a dispenser gun, or may be threaded onto the end of an adapter 11, depending upon the construction of the dispenser to which the nozzle is attached. If the adapter 11 is utilized, a small diameter rear end section 30 of the adapter is threaded into an internally threaded bore of the dispenser, and the nut 12 is threaded over the large diameter forwardmost section of the adapter. In either event, the nut has an inwardly extending flange 32 on its forward end, which flange 32 engages the forward face 33 of the flange 14 of the nozzle body so as to pull the flange and thus the rear face 21 of the nozzle body 10 into sealed engagement with either the front face of the dispenser gun (in the absence of the adapter 11) or with the forward face 34 of the adapter 11.

In one preferred embodiment of the invention of this application, the bores 20 and 24 were selected to be approximately 0.130 inch in diameter and the insert 27, which was brazed into the bore 20, had an internal diameter in the range from 0.020" to 0.080". The diameter selected for the bore 28 is determined by the quantity of foamed hot melt intended to be dispensed from the nozzle while maintaining a back pressure upstream from the nozzle insert 27 on the order of 500–1200 p.s.i. If the back pressure drops below this pressure, the gas contained in the hot melt/gas solution tends to come out of solution within the gun with the result that the foam is less homogeneous and the hot melt dispensed from the gun contains less than the proper amount of gas in the foam. By utilizing nozzles having differing size bores in the insert 27, the quantity of hot melt dispensed from the guns employing the nozzle may be varied while still maintaining a proper back pressure in the gun.

In use, a molten hot melt/gas mixture wherein the gas is in solution in the liquid is supplied through a conventional valved dispenser to the bore 35 of the adapter and subsequently through the restricted orifice 28 to the discharge orifice 26 of the nozzle. By forcing the molten hot melt/gas mixture to flow through the restricted orifice 28 and through the circuitous flow path defined by the intersecting bores 22, 24 before being discharged from the nozzle orifice 26, the back pressure is maintained on the hot melt/gas solution upstream of the restrictor orifice 28 and the velocity of the hot melt/gas mixture is materially reduced upon impact of the high velocity hot melt/gas mixture with the forward wall 36 of the bore 22. The exit velocity of the molten material is greatly reduced at this point and it is at this point 36 that the gas begins to come out of solution. Reduction of the hot/melt gas solution velocity at this point has several beneficial results. Firstly, it reduces the danger of injury resulting from a person being sprayed with a high pressure stream of molten hot melt from the nozzle. Secondly, it improves the control of deposition which results when the hot melt is dispensed from the orifice. And thirdly, it has been found to materially improve the quality of the foam dispensed from the nozzle by increasing the mixing of air within the foam before the foam exits the nozzle orifice. In other words, the use of this nozzle has been found to improve the quality of foam dispensed from the nozzle of a foamed hot melt dispenser by better mixing the air within the foam so that more consistent foam is dispensed from the nozzle.

In the foregoing description, and throughout this specification and the claims, the term "solution" is used to describe the liquid hot melt/gas dispersion supplied under high pressure to the gun, which dispersion when dispensed from the gun at atmospheric pressure cools and creates a foamed hot melt. The applicants are of the view that this mixture is a true solution in which the molecules of the dissolved gas are dispersed among those of the liquid hot melt. The term "solution", though, as used in the specification and the claims of the application is intended to encompass the broader generic definition of solution which is a gas homogeneously mixed with the molten liquid hot melt, whether or not the molecules of the dissolved gas are in fact dispersed among those of the solvent.

While we have described only a single preferred embodiment of our invention, persons skilled in this art will appreciate changes and modifications which may be made without departing from tne spirit of our invention. Therefore, we do not intend to be limited except by the scope of the following appended claims:

We claim:

1. A nozzle for dispensing a solution of liquid and gas, from which solution the gas is released to form a foam upon said solution emerging from said nozzle, which nozzle comprises, an inlet opening and a discharge orifice, a liquid flow passage extending between said inlet opening and said discharge orifice, said liquid flow passage comprising, a first longitudinally extending small diameter bore in fluid communication with said inlet opening, a second bore colinearly aligned with said first bore and in fluid communication with said first bore, said second bore being substantially larger in diameter than said first bore, a third longitudinally extending bore in fluid communication with said discharge orifice, said third bore being generally parallel to said second bore and intersecting said second bore but being laterally offset from said second bore.

2. The nozzle of claim 1 wherein said second bore extends into said nozzle from said inlet opening and in which said first bore is contained within an insert sealingly secured within said second bore.

3. The nozzle of claim 1 wherein said second and third bores are of substantially the same diameter.

4. A nozzle for dispensing molten thermoplastic material, which nozzle comprises, an inlet opening and a discharge orifice, a liquid flow passage extending between said inlet opening and said discharge orifice, said liquid flow passage comprising, a first longitudinally extending small diameter bore in fluid communication with said inlet opening, a second bore colinearly aligned with said first bore and in fluid communication with said first bore, said second bore being substantially larger in diameter than said first bore, a third longitudinally extending bore in fluid communication with said discharge orifice, said third bore being generally parallel to said second bore and intersecting said second bore but being laterally offset from said second bore.

5. A method of dispensing a uniform quality of foamed thermoplastic material from a nozzle, which method comprises, supplying a high pressure solution of liquid and gas to the inlet of a nozzle body having an inlet orifice, a discharge orifice, and a flow passage extending between said orifices, causing the solution of liquid and gas to pass through a first small diameter restricted bore adjacent said inlet orifice of said nozzle body before entering a second larger diameter bore in said flow passage, and mixing said solution of liquid and gas by impacting said solution with an end wall of said second bore before causing said solution to pass to said discharge orifice through a third large diameter bore extending parallel to said second bore but laterally offset from said second bore.

6. A method of dispensing a uniform quality of foamed thermoplastic material from a nozzle, which method comprises, supplying a high pressure solution of liquid and gas to the inlet of a nozzle body having an inlet orifice, a discharge orifice, and a flow passage extending between said orifices, causing the solution of liquid and gas to pass through a first small diameter restricted bore adjacent said inlet orifice of said nozzle body before entering a second larger diameter bore in said flow passage, said second large diameter bore being colinearly aligned with said first bore, and mixing said solution of liquid and gas by impacting said solution with an end wall of said second bore before causing said solution to pass to said discharge orifice through a third large diameter bore, said third bore extending parallel to said second bore but being laterally offset from and intersecting said second bore.

* * * * *